US006619621B2

(12) United States Patent
Alten

(10) Patent No.: US 6,619,621 B2
(45) Date of Patent: Sep. 16, 2003

(54) CAR JACK

(75) Inventor: Ferdinand Alten, Mandern (DE)

(73) Assignee: ThyssenKrupp Bilstein GmbH, Bochum (DE)

( * ) Notice: Subject to any disclaimer, the term of this patent is extended or adjusted under 35 U.S.C. 154(b) by 0 days.

(21) Appl. No.: 10/088,547

(22) PCT Filed: Jun. 20, 2001

(86) PCT No.: PCT/EP01/06934

§ 371 (c)(1),
(2), (4) Date: Mar. 15, 2002

(87) PCT Pub. No.: WO02/06150

PCT Pub. Date: Jan. 24, 2002

(65) Prior Publication Data

US 2002/0134972 A1 Sep. 26, 2002

(30) Foreign Application Priority Data

Jul. 19, 2000 (DE) ..... 100 35 165

(51) Int. Cl.[7] ..... B66F 3/00

(52) U.S. Cl. ..... 254/126; 254/133 R

(58) Field of Search ..... 254/126, DIG. 1, 254/100, 101, 124, 7 R, 7 B, 7 C, 9 B, 98, 122, 129

(56) References Cited

U.S. PATENT DOCUMENTS 4,093,182 A * 6/1978 Rutenbeck ..... 254/126
5,386,969 A * 2/1995 Popowich ..... 254/133 R
5,460,352 A * 10/1995 Calafi ..... 254/126
6,022,001 A * 2/2000 Palacio et al. ..... 254/126
6,068,239 A * 5/2000 Palacio ..... 254/126

FOREIGN PATENT DOCUMENTS

GB 2036690 * 7/1980 ..... 254/126

* cited by examiner

*Primary Examiner*—George Nguyen
*Assistant Examiner*—Daniel Shanley
(74) *Attorney, Agent, or Firm*—Max Fogiel

(57) ABSTRACT

Jack with an erect component in the form of a leg (1) that rests against the ground (4) and of a foot (2) articulated thereto and with a vehicle-lifting arm (6) that pivots around a fixed horizontal axis on the leg. The arm can be directly or indirectly raised or lowered away from and toward the ground by means of a spindle (7). The arm is provided with a fixed or pivoting vehicle-supporting component at its free end. At the other end, which engages the leg, the arm is provided with appropriate controls that displace a slide (10) along the leg such that the lower end (19) of the slide can come to rest against the leg-supporting surface (3) of the foot. The object is a lighter-weight jack that will be just as sturdy. A stop (21) is accordingly positioned on top of the leg-supporting surface and facing the slide's lower end.

9 Claims, 2 Drawing Sheets

CAR JACK

BACKGROUND OF THE INVENTION

The present invention concerns a jack with an erect component that rests against the ground and with a vehicle-supporting arm that pivots around a horizontal axis on the erect components.

In a jack with a leg that rests against the ground by way of a foot and with an arm that pivots up at one end around an axis on the leg and raises the vehicle relative to the leg, care must in particular be taken to ensure that the leg can be applied, erected on the ground, that is, at a specific angle to the vehicle and to the ground. This approach is the only way to ensure that the load will be correctly accommodated as the vehicle is raised and to prevent the jack and hence the vehicle from slipping out of alignment because the line of force does not extend perpendicular through the foot. To facilitate application of the jack with the leg at the proper angle to the ground even when employed by unskilled individuals accordingly, European Patent 0 688 736 A1 discloses a slide that travels back and forth along the leg subject to the motion of the arm and establishes the jack's angle of application by controlling the motion of the foot articulated to the leg.

One end of the foot-motion controlling slide rests against the top of the foot's leg-supporting surface. At this end, the slide is bent out either forward or backward depending on the jack's kinematics and on the point where the jack comes into contact with the vehicle.

There is a drawback to this embodiment, especially when the slide does not rest perpendicular against the foot, resulting in powerful lateral force components. In this event, the slide must be especially bending-resistant and its lower guide correspondingly thick. The embodiment accordingly requires a lot of material.

SUMMARY OF THE INVENTION

The object of the present invention is a lighter-weight jack, and one that will be less heavy to transport in the vehicle.

The stop on the foot's leg-supporting surface and facing the end of the slide precisely establishes the end's position. The bending forces on the slide are considerably decreased if not entirely eliminated. The slide and its lower guide can be thinner with no sacrifice of overall force against the foot. This design saves material and manufacturing costs, especially when the stop is in the form of a crimp in the foot.

DESCRIPTION OF THE PREFERRED EMBODIMENTS

Figure 1:
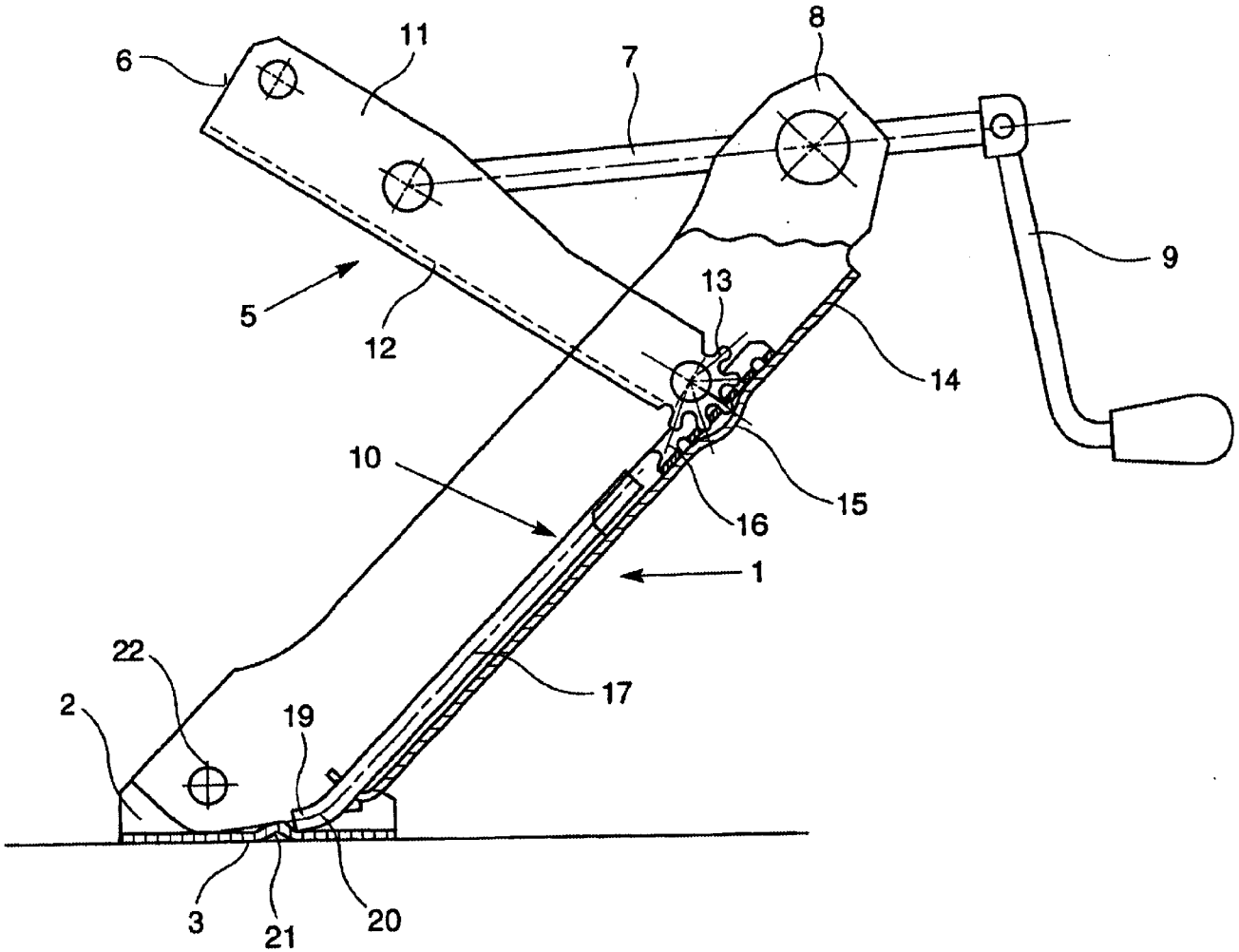
FIG. 1 is schematic elevational view showing the elements of the jack in accordance with the present invention.
Figure 2:
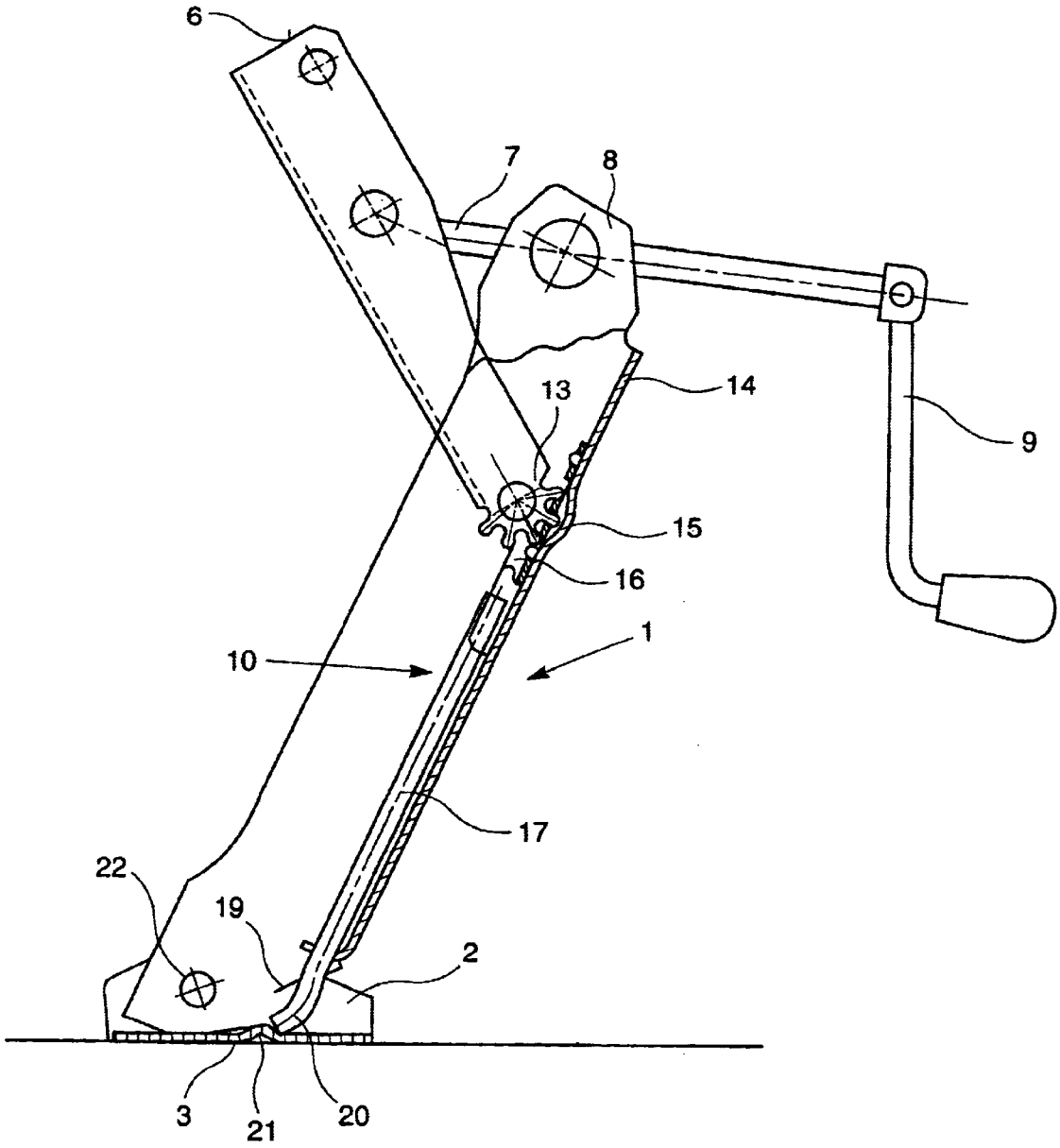
FIG. 2 is a schematic elevational view showing the jack of FIG. 1 in another position after having been operated to lift a vehicle.

The jack in the illustrated embodiment is an articulated single-arm jack with a foot pivoting on it. It is provided with an erect component in the form of a leg 1 with a foot 2 pivoting on it at the leg-supporting end and with a leg-supporting surface 3 resting against ground 4. A vehicle-lifting arm 5 is articulated to the upper section of leg 1. An unillustrated vehicle-supporting component matching the contact surface of the vehicle being lifted is mounted on the free end 6 of arm 5. This component can be articulated or otherwise attached to the arm and can for example fit the vehicle's sill. Leg 1 and arm 5 are connected by a threaded drive spindle 7 conventionally provided with a crank 9. An unillustrated traveling nut at the upper end 8 of leg 1 pivots arm 5 relative to leg 1 as crank 9 is turned, raising or lowering free end 6 and hence lifting the vehicle off or lowering it onto ground 4.

The angle of articulation between the foot 2 and leg 1 in the illustrated embodiment is controlled by a slide 10.

Foot 2, leg 1, and arm 5 are all fabricated from lengths of metal U section, each comprising a web 12 and two flanges 11. At the end of arm 5 remote from free end 6, flanges 11 are each provided with a cogged segment 13 extending approximately 180°. The cogs in the present example are rounded. Web 12 does not extend as far as segment 13. The web 14 in leg 1 is provided with a convexly outward recess 15 in the vicinity of segment 13 that allows the segment to rotate freely.

Slide 10 is in two parts, comprising a guide 16 and a pusher 17. The guide 16 in the illustrated example is a length of metal W section. The cogs in segment 13 engage matching gaps 18 in guide 16. The pusher 17 in the illustrated example is in the form of a rod with a bend 20 at its lower end 19. Bend 20 applies force against the web that constitutes the web of foot 2. The length and angle of bend 20 determines where lower end 19 will rest against the leg-supporting surface 3 of foot 2, allowing the foot's performance to be adopted to the characteristics of the specific vehicle being lifted.

A stop 21 is positioned on the upper surface of leg-supporting surface 3 and facing the lower end 19 of bend 20. The stop 21 in the illustrated example is in the form of an elevated transverse crimp in leg-supporting surface 3. The stop must of course conform with the overall design of the jack. Specifically, the exact position of the stop in relation to the point 22 of articulation of foot 2 to leg 1 will depend on the characteristics of the bend at lower end 19. When jacks are manufactured in small numbers accordingly, it can be economical to fabricate the foot with a smooth leg-supporting surface 3 and apply the stop later in the form of a rivet or welded-on pin. Although this approach will result in a slightly heavier jack, it will entail several advantages in small-scale manufacture.

List of Parts

1. leg
2. foot
3. leg-supporting surface
4. ground
5. vehicle-lifting arm
6. free end of arm 5
7. spindle
8. upper end of leg 1
9. crank
10. slide
11. flanges
12. web
13. cogged segment
14. web
15. outward recess
16. guide
17. pusher
18. gaps
19. lower end
20. bend

21. stop

22. point of articulation

What is claimed is:

1. A jack comprising an erect component in a form of a leg resting against a ground; a foot articulated to said leg by a pivot connecting said foot to said leg; a vehicle-lifting arm pivoting around a fixed horizontal axis on said leg and raisable away from and lowerable toward the ground by a spindle; said lifting arm having a vehicle-supporting component at a free end on said arm and having another end engaging said leg; a slide with mans for controlling displacement of said slide along the leg so that a lower end of said slide can come to rest aganist a leg-supporting surface of said foot; a stop positioned on top of said leg-supporting surface and facing a lower end of said slide, said foot pivoting relative to said leg when said spindle is rotated for raising or lowering a vehicle, rotation of said spindle moving said leg and pivoting said foot correspondingly so that said foot remains in place on the ground during rotation of said spindle.

2. A jack as defined in claim 1, wherein said stop is a rivet.

3. A jack as defined in claim 1, wherein said stop is a crimp in said leg-supporting surface.

4. A jack as defined in claim 1, wherein said leg can be directly raised or lowered.

5. A jack as defined in claim 1, wherein said leg can be indirectly raised or lowered.

6. A jack as defined in claim 1, wherein said vehicle-supporting component is fixed in place.

7. A jack as defined in claim 1, wherein said vehicle-supporting component is a pivoting component.

8. A jack as defined in claim 1, wherein said stop is a welded-on pin.

9. A jack comprising an erect component in form of a leg resting against a ground; a foot articulated to said leg by a pivot connecting said foot to said leg; a vehicle-lifting arm pivoting around a fixed horizontal axis on said leg and raisable away from and lowerable toward the ground by a spindle; said lifting arm having another end engaging said leg; a slide with means for controlling displacement of the slide along the leg so that a lower end of said slide can come to rest against a leg-supporting surface of said foot; a stop positioned on top of said leg-supporting surface and facing a lower end of said slide; said leg having a longitudinal axis, said controlling means displacing said slide parallel to said longitudinal axis of said leg, so that said slide stands up on said leg-supporting surface of said foot, said foot pivoting relative to said leg when said spindle is rotated for raising or lowering a vehicle, rotation of said spindle moving said leg and pivoting said foot correspondingly so that said foot remains in place on the ground during rotation of said spindle.

* * * * *